US007104094B2

(12) United States Patent
Zadak et al.

(10) Patent No.: US 7,104,094 B2
(45) Date of Patent: Sep. 12, 2006

(54) MERCHANDISE LOCK BAR SYSTEM AND METHOD

(75) Inventors: Craig Zadak, Roscoe, IL (US); Joseph E. Gormley, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 10/663,601

(22) Filed: Sep. 16, 2003

(65) Prior Publication Data

US 2005/0056063 A1 Mar. 17, 2005

(51) Int. Cl.
*E05B 73/00* (2006.01)

(52) U.S. Cl. ..... 70/58; 70/57; 70/58; 211/4

(58) Field of Classification Search ..... 70/57.1, 70/57, 58–62; 211/4, 6, 9, 5
See application file for complete search history.

(56) References Cited

U.S. PATENT DOCUMENTS 1,856,239 A * 5/1932 Buckley ..... 211/4
3,908,949 A * 9/1975 Larson ..... 248/220.43
4,155,458 A * 5/1979 Moline ..... 70/61
4,289,242 A * 9/1981 Kenyon ..... 211/4
4,462,497 A * 7/1984 Maule ..... 211/7
4,882,868 A * 11/1989 Fast ..... 211/59.1
5,259,220 A * 11/1993 Fredrickson ..... 70/14
5,348,167 A * 9/1994 Jensen ..... 211/59.1
5,407,170 A * 4/1995 Slivon et al. ..... 211/7
5,520,291 A * 5/1996 Graham ..... 70/58
5,533,079 A * 7/1996 Colburn et al. ..... 377/6
5,676,258 A * 10/1997 Leyden et al. ..... 70/14
5,823,358 A * 10/1998 Leyden et al. ..... 70/59
6,474,478 B1 * 11/2002 Huehner et al. ..... 211/4
6,491,169 B1 * 12/2002 Salonen ..... 211/4
6,659,291 B1 * 12/2003 Huehner et al. ..... 211/4
6,957,555 B1 * 10/2005 Nagel et al. ..... 70/57.1
2002/0179546 A1 * 12/2002 McMurray et al. ..... 70/58
2004/0155000 A1 * 8/2004 Mele et al. ..... 211/4

* cited by examiner

*Primary Examiner*—Suzanne Dino Barrett
*Assistant Examiner*—Christopher Boswell
(74) *Attorney, Agent, or Firm*—Reinhart Boerner Van Deuren P.C.

(57) ABSTRACT

The invention provides an improved lock bar system for enclosing at least one peg hook. The lock bar system can be in a merchandising display with the lock bar system including a peg hook support frame mounted to the merchandising display supporting a plurality of peg hooks in lateral spaced relation. The peg hooks include forward extending rods for supporting retail product, the peg hook support frame supporting a movable product retainer extending across forward ends of the plurality of peg hooks, the product retainer subject to a lock having a locked condition preventing removal of product from the peg hooks and an unlocked condition permitting removal of product from the peg hooks.

17 Claims, 5 Drawing Sheets

MERCHANDISE LOCK BAR SYSTEM AND METHOD

FIELD OF THE INVENTION

The present invention relates generally lock bar, and, more particularly, relates to a merchandise lock bar that allows secure display of merchandise on merchandise hooks.

BACKGROUND OF THE INVENTION

This invention relates to a locking bar system for merchandise. More particularly, it is for locking display merchandise that is placed on rods extending from a wall or pegboard. Merchandise is typically displayed to enable a customer to see merchandise and select items prior to purchasing. However, shoplifting is a known problem in retail settings, especially for high priced items.

It would be desirable to enable customers to view merchandise, even high-priced merchandise, on a display. Prior art methods of protecting merchandise include U.S. Pat. No. 5,027,622 to Hatch et al. (Jul. 2, 1991), which includes a locking device for attaching to individual peg hooks. Individually locking peg hooks, however, is inefficient in that store clerks must unlock each peg hook one at a time for customers. Moreover, by locking only the forward end of a peg hook, shop lifters can choose to remove the peg hook entirely to pilfer product. What is needed is an efficient and efficacious system and method for protecting product on peg hooks.

BRIEF SUMMARY OF THE INVENTION

The invention provides an improved lock bar system for enclosing at least one peg hook. The lock bar system can be in a merchandising display with the lock bar system including a peg hook support frame mounted to the merchandising display supporting a plurality of peg hooks in lateral spaced relation. The peg hooks include forward extending rods for supporting retail product, the peg hook support frame supporting a movable product retainer extending across forward ends of the plurality of peg hooks, the product retainer subject to a lock having a locked condition preventing removal of product from the peg hooks and an unlocked condition permitting removal of product from the peg hooks.

Another embodiment is directed to a lock bar system for enclosing at least one peg hook protruding from a merchandising display. The lock bar system includes a frame configured to be attachable to a support, the frame including a peg hook support rear security rod and a peg hook support bar, a product retainer hingedly connected to the frame, the product retainer including a lower security rod and an upper security bar; and a lock mechanism coupled to the product retainer, the lock mechanism configured to prevent the product retainer from rotating by securing the product retainer to the frame. The product retainer protects product hanging from a plurality of peg hooks secured to the lock bar system by preventing the product from passing past the lower security rod and the upper security rod when the lock bar system is in a closed position. The frame is mounted to the merchandising display via mounting brackets on the merchandising display so that the brackets receive the frame via apertures for cantilevered support. The lock mechanism is a keyed lock configured to secure the product retainer to the frame. The upper security bar includes a label holder designed to hold labels for identifying product suspended on the peg hook.

DETAILED DESCRIPTION OF THE INVENTION

Figure 1:
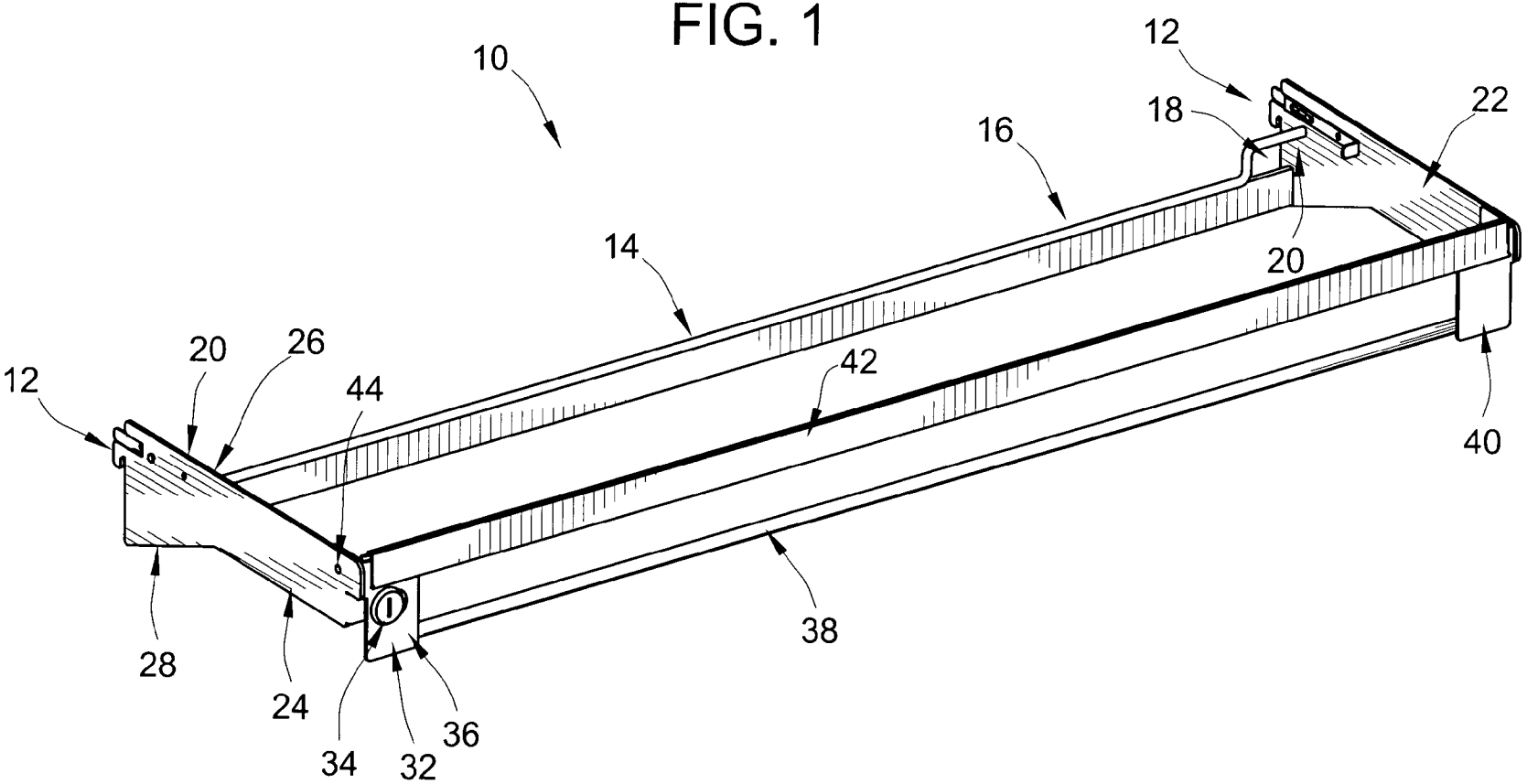
FIG. 1 is a perspective view of one embodiment of the lock bar system constructed in accordance with the teachings of the present invention.

Turning now to the drawings, an embodiment of the present invention is depicted in FIG. 1. FIG. 1 illustrates a lock bar system 10 designed to be attached to a merchandising gondola or the like via hooks 12. Lock bar system 10 can be manufactured using a metal, such as steel or the like. The lock bar system 10 includes a rear security rod 14 and a peg hook support bar 16 for supporting peg hook backs. Peg hook backs for peg hooks or combination peg hook backs and peg hooks can be slidably inserted via entrance cavity 18, which is formed by two generally perpendicular bends at a first end 20 of peg hook support bar 16. The first end 20 is connected to first side wall 22.

Lock bar system 10 includes a second side wall 24. Both side walls 22 and 24 are formed with a level top edge 26 and a bottom edge with an angled rear edge portion 28 and a forward bottom level edge 30. The side walls 22 and 24 can be comprised of either panel type construction, steel rod construction or other appropriate construction that can be secured to mounting brackets and support the components of lock bar system 10, as will be appreciated by one of skill in the art with the benefit of the present disclosure. The side walls 22 and 24 are connected to peg hook support bar 16 and rear security rod 14, which together form a frame. The strength and the size of the frame, as design requirements dictate, can be manufactured to provide secure display according to the products to be displayed. Thus, for example, bulkier heavy product would mandate a strong steel construction, and lighter weight product would command a lighter weight construction, such as aluminum. If product to be displayed is a type mandating increased security due to expense of replacement, lock bar system 10 could be constructed of a strong steel regardless of the size and weight of the product.

Side wall 24 is shown coupled to locking mechanism 32, including a keyed mechanism 34. Keyed mechanism 34 could also be another type of locking mechanism, as one of skill in the art with the benefit of this disclosure will appreciate. Keyed mechanism 34 is attached to metal base plate 36 appropriately configured to receive a locking mechanism. Base plate 36 is coupled to a first end of forward lower security bar 38, which can be implemented as a rod connecting base plate 36 to base plate 40. Base plate 40 is shown coupled to a second end of forward lower security rod 38. Both base plate 36 and base plate 40 are configured as forward facing plates with a 90 degree rearward bent portion designed to be interior to sidewalls 24 and 22, respectively.

The rearward bent portion is coupled to the frame using attachment means, such as bolt 44, to provide motility in the upward dimension. To prevent downward motion, sidewall 24 and sidewall 22 each have a forward inward bent portion that functions as a stop to support rearward bent portion of bases 36 and 40. Attached to both base plate 36 and base plate 40, along with rod 38, is upper security bar 42. Upper security bar 42 can be configured to avoid interruption with products displayed on peg hooks.

Upper security bar 42, lower security rod 38, key mechanism 34, and base plates 36 and 40 together form a product retaining structure that functions as a retainer to prevent product disposed on peg hooks sized for lock bar system 10 from being removed independent of an open lock bar position. Thus, product retaining structure has two modes or conditions of operation. In a first locked mode, product is prevented from exiting a peg hook because lower security rod 38 prevents forward motion of product suspended on the peg hook and upper security bar 42 prevents an upper portion of product suspended from the peg hook from sliding forward on the peg hook. In an unlocked mode, product can be removed by lifting the product retaining structure above the exiting portion of the peg hook.

Lock bar system 10 is shown in closed position. That is to say, a hinge mechanism 44 is disposed on each side wall 22 and 24 that permits store clerks and authorized personnel with an appropriate security vehicle, such as a key, combination, code or the like to lift the combination of lower security rod 38, upper security bar 42 and base plates 36 and 40, including keyed mechanism 32.

Figure 2A:
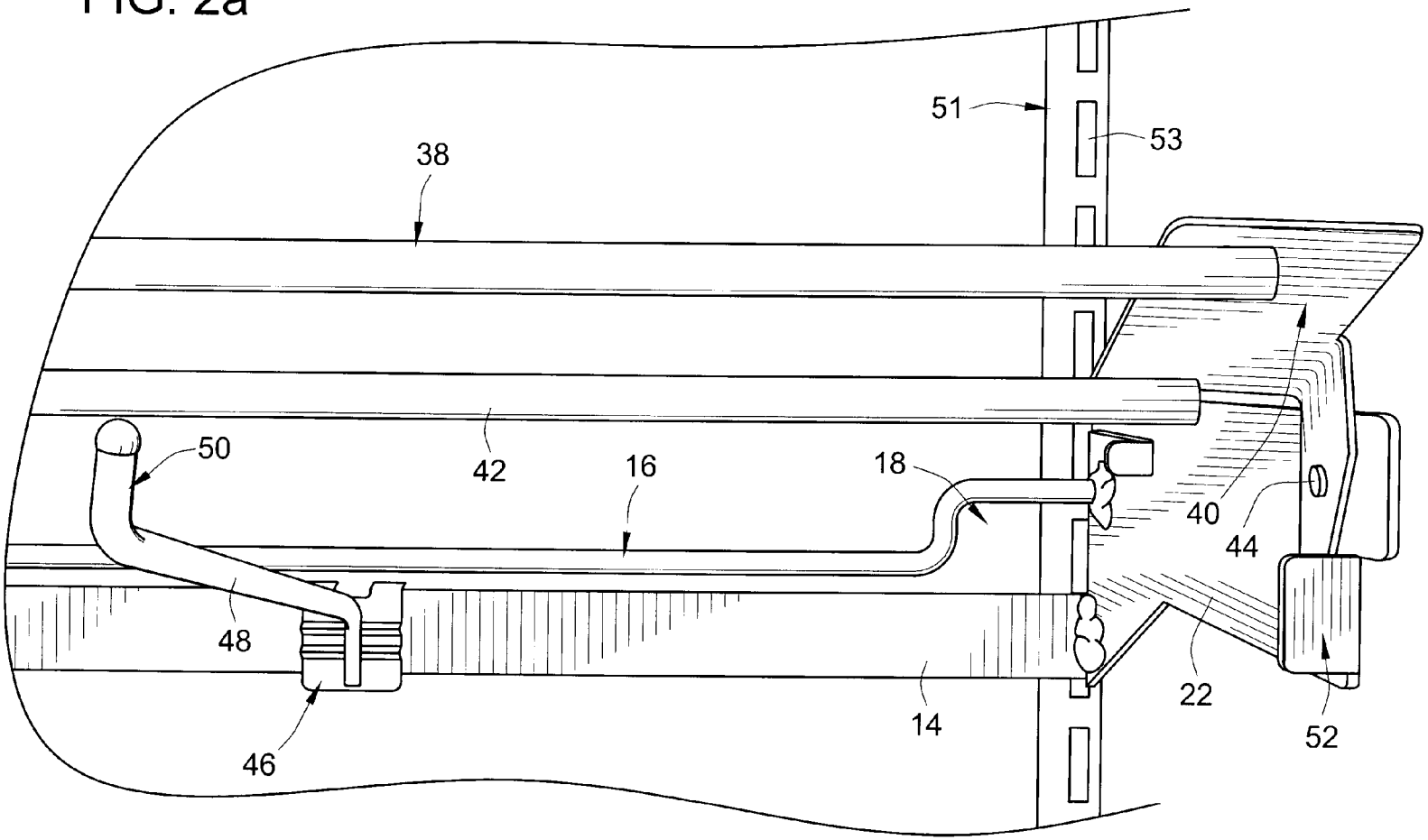
FIG. 2A is a cut-away perspective view of the lock bar system illustrating an open right side constructed in accordance with the teachings of the present invention.

Referring now to FIG. 2A, lock bar system 10 is shown in open position with a peg hook back 46 and peg hook 48 in place. With lock bar system 10 in open position, store clerks are able to place products over bent free end 50 of peg hook 48 and any other peg hooks disposed below peg hook support bar 16. As shown, lower security rod 38 and upper security bar 42 hingedly lift above peg hook 48. Base plate 40 is shown lifting with security rod 38 and bar 42. Open lock bar system 10 reveals stop 52, which butts against base plate 40 when lock bar system 10 is in a closed position. Stop 52 is formed by the forward inward bent portion of each side wall 24 and 22. FIG. 2 also shows mounting bracket 51 with a plurality of apertures 53. Lock bar system 10 is supported on a merchandising display via a cantilever force of hooks on the frame inserted into apertures 53.

Figure 2B:
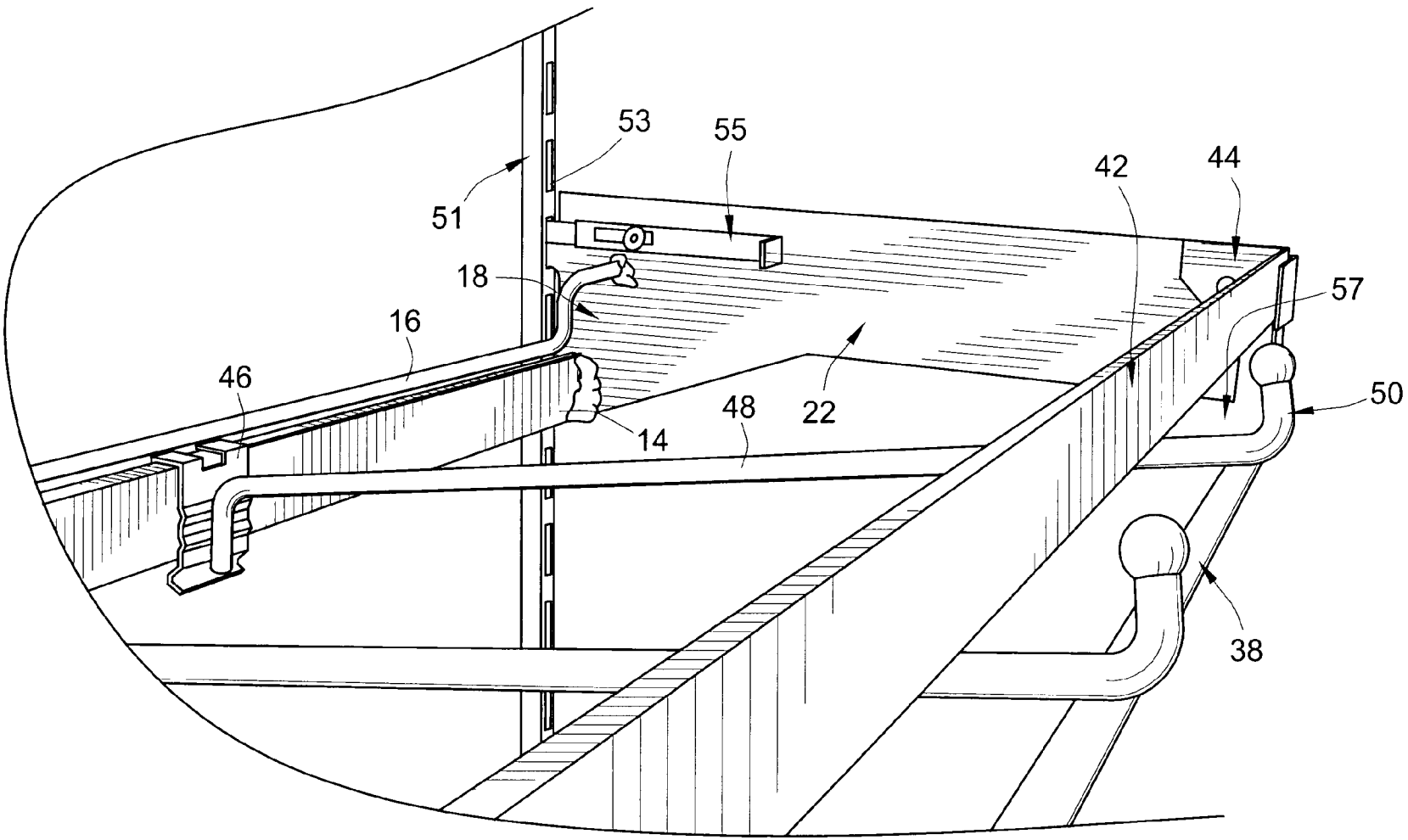
FIG. 2B is a cut-away perspective view of the lock bar system illustrating a closed right side constructed in accordance with the teachings of the present invention.

FIG. 2B illustrates lock bar system 10 in a closed position with peg hook back 46 and peg hook 48 in place. A peg hook 48 appropriate for the invention includes a rod extending from peg hook back 46, as shown, peg hook 48 includes an elongated rod with a forward end 57 that includes a free end 50 of the rod that is bent at an angle such that the bent free end protrudes between upper security bar 42 and lower security rod 38, and upward in front of upper security bar 42. Hanging products on peg hook 48 situated behind bar 42 are prevented from removal by both upper bar 42 and lower bar 38.

Figure 3:
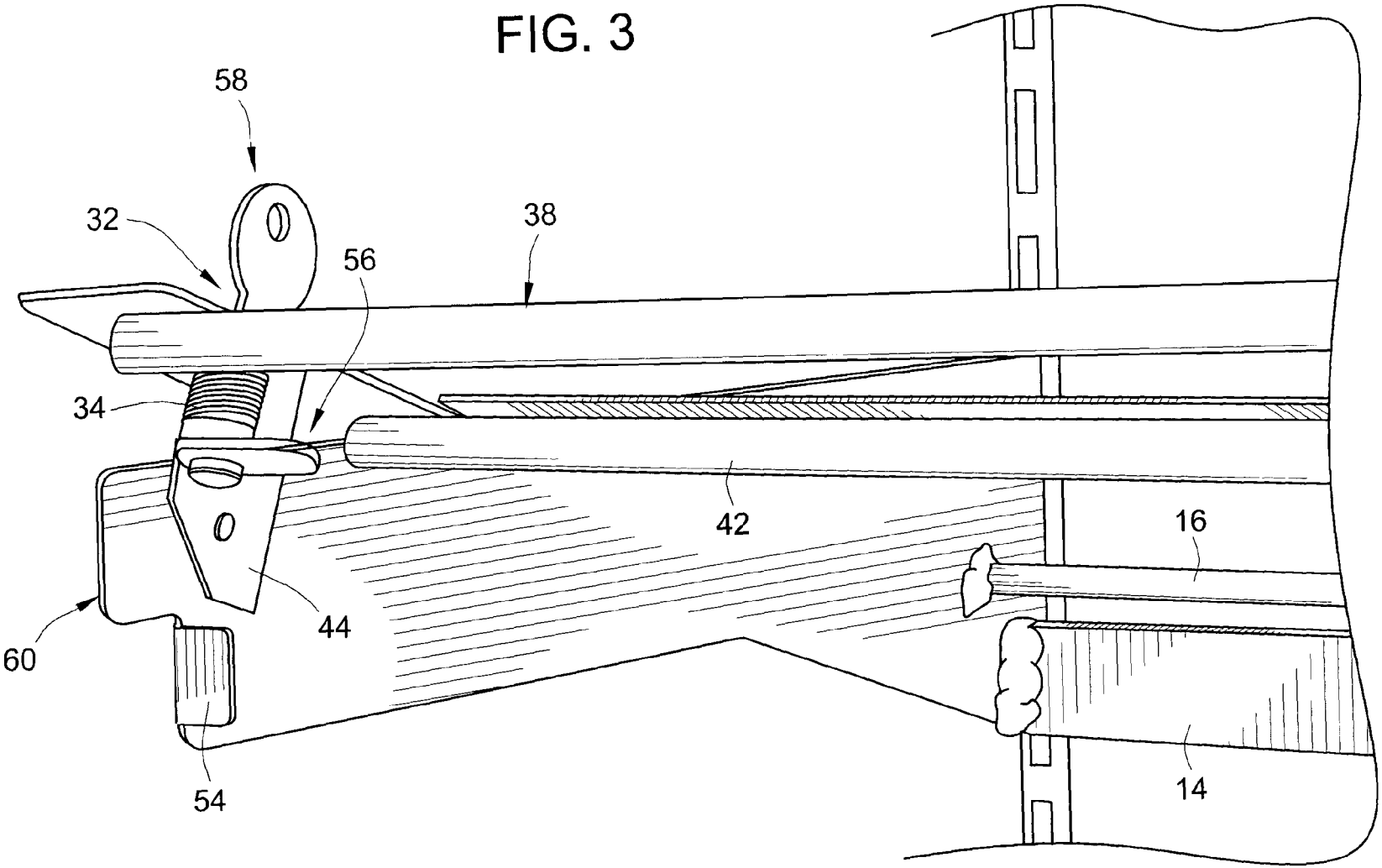
FIG. 3 is a cut-away perspective view of the lock bar system illustrating an open left side constructed in accordance with the teachings of the present invention.

Referring now to FIG. 3, lock bar system 10 is shown in an open position with keyed mechanism 32 shown in further detail. More specifically, FIG. 3 shows stop 54, which functions, like stop 52, to butt against base plate 36 when lock bar system 10 is in a closed position. Moreover, stop 52 further functions as part of locking mechanism 32 by functioning as a keeper plate for securing latch member 56. That is to say stop 54 cooperates with locking mechanism 32 to lock the combination of upper security bar 42 and lower security rod 38 in its closed position. A key 58 activates locking mechanism 32 to urge latch 56 to rotate behind stop 54 to retain lock bar system 10 in a closed position. Lowering lower security rod 38 and upper security bar 42 encloses any peg hooks holding merchandise in need of security.

Figure 4:
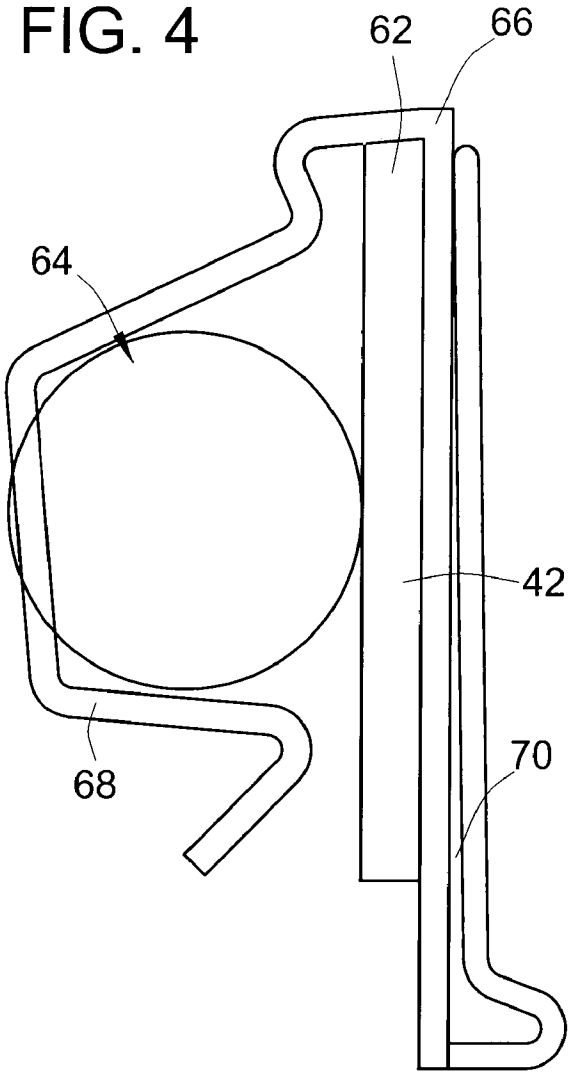
FIG. 4 is a cross section of a portion of the lock bar system illustrating an embodiment in accordance with the teachings of the present invention.

Referring now to FIG. 4, a cross section of upper security bar 42 is shown to illustrate that bar 42 can be configured to receive a label holder such as a label holder for a flat faced shelf channel. Specifically, bar 42 includes security rod 64 connected to front bar 62. A label holder 66 is shown positioned over both front bar 62 and rod 64. Accordingly, upper security bar 42 can be configured to have a dual purpose of both providing a channel for label holders and for enclosing products, such as products associated with labels in the label holders. As one of skill in the art will appreciate, upper security bar 42 can be configured to receive additional types of label holders. Further label holder 66 can be extruded plastic, such as an appropriate plastic material such as polyvinyl chloride, co-extruded polyvinyl chloride, butyrate, provista or acrylonitrile butadiene styrene (ABS). The label holder 66 can be approximately between 1 and 1½ inches in height. To install a label holder onto bar 42, a label holder back 68 must be resilient enough to hingedly stretch over rod 64 while front label panels 70 abut the face of bar 62.

Another embodiment of the invention is directed to a method for securing product in a merchandising display. More specifically, the method provides for installing a plurality of peg hooks on peg hook support bar 14 with the peg hook support bar supported by mounting brackets 51 connected to the merchandising display. A store clerk then can place product on the peg hooks. The method then provides for securing a product retaining structure, such as a product retaining structure including upper security bar 42 and lower security rod 38, the upper security bar 42 and the lower security rod 38 in vertical space relation and normal to the forward end 57 of the peg hooks 48 when in a closed mode. In one embodiment, the method also includes removing product by unlocking a lock mechanism coupled to the product retaining structure and lifting the product retaining structure upwardly such that the upper security bar and the lower security rod are suspended above the peg hooks to allow product to be removed.

In one embodiment of the method installing the plurality of peg hooks includes placing each peg hook back 46 onto the peg hook support bar 14 via an entrance cavity 18 between the peg hook support bar 14 and peg hook security rod 16 when the product retaining structure is in an open mode.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A lock bar merchandise system for selectively securing merchandise to a vertical support, comprising:

a lock bar assembly mounted to the vertical support, the lock bar assembly including a pair of sides in lateral spaced relations, the sides extending forwardly relative to the vertical support, and a product retainer extending laterally between the sides to define an open area for storage of merchandise, and a lock adapted to secure the product retainer, the product retainer being a separate member from the sides and movable, relative to the sides such that the product retainer is not unitary with the sides;

a row of peg hooks disposed in spaced lateral relation between the sides of the lock bar assembly, each peg hook including a product retainer arm projecting generally forward through the open area relative to the vertical support, each product retainer arm adapted to support merchandise;

wherein the lock includes a locked condition in which a front portion of each product retainer arm is trapped by the product retainer, and an unlocked condition in which the front portion of each product retainer arm is free of the product retainer for installation or removal of merchandise; and wherein respective hinges connect each side to the product retainer, the product retainer pivotable relative to the sides upwardly and downwardly via the hinges.

2. The lock bar merchandise system of claim 1, wherein the product retainer includes upper and lower security bars extending in lateral spaced relation with a gap formed therebetween, and wherein a free forward end of the product retainer arm for each peg hook is trapped in the gap in the locked condition.

3. The lock bar merchandise system of claim 2, wherein the product retainer is pivoted relative to the sides about the hinges when moved from the locked condition to the unlocked condition.

4. The lock bar merchandise system of claim 1, wherein the lock bar assembly includes a peg hook support bar extending laterally between the sides, the peg hook support bar being spaced rearward of the product retainer proximate the vertical support, and wherein each peg hook includes a mounting bracket, the mounting bracket of each peg hook being slidably mounted on the peg hook support bar.

5. The lock bar merchandise system of claim 4, wherein the lock bar assembly includes a peg hook security rod extending laterally between the sides, the peg hook security rod extending coextensively with the peg hook support bar along a substantial portion thereof to trap the mounting brackets of different peg hooks on the lock bar assembly and prevent removal therefrom.

6. The lock bar merchandise system of claim 5, wherein the peg hook support bar and the peg hook security rod define a substantially constant gap which traps the mounting brackets, and a larger entrance opening which provides means for slidably installing and removing mounting brackets of peg hooks on the peg hook support bar.

7. The lock bar merchandise system of claim 4, wherein each mounting bracket includes a front panel disposed over a front face of the peg hook support bar, and a hook wrapped over a top of the peg hook support bar, the product retainer arm being mounted to the front panel.

8. The lock bar merchandise system of claim 1, wherein each side includes a mounting hook securing the lock bar assembly to the vertical support.

9. The lock bar merchandise system of claim 1, further comprising a label holder mounted to the product retainer.

10. The lock bar merchandise system of claim 1, wherein the lock is integral with the product retainer and the sides, the lock comprising a keyed mechanism carried by the product retainer, the key mechanism having a movable latch actuated by a key, and wherein the lock includes a stop defined by one of the sides, the latch cooperating with the stop in the locked condition to prevent movement of the product retainer.

11. The lock bar merchandise system of claim 1, wherein the product retainer arm of each peg hook defines a upwardly bent free end.

12. A lock bar assembly for selectively securing merchandise via peg hooks to a vertical support, comprising:

a pair of sides disposed in lateral spaced relation, each side having a mounting hook such that each side is adapted to mount to the vertical support, each side extending forwardly from the mounting hook to a front end;

a product retainer extending laterally between the respective sides between the respective front ends thereof, the product retainer including upper and lower security bars extending in lateral spaced relation with a gap formed therebetween;

a lock having a locked position fixing the product retainer relative to the sides and an unlocked position in which the product retainer is movable relative to the sides;

a support bar mounted to each of the sides and extending laterally therebetween rearward of the product retainer; and a plurality of hinges pivotably connecting the product retainer to the sides proximate the front end wherein the product retainer is pivotable upwardly and downwardly about the hinges relative to the sides when moved from the locked condition to the unlocked condition.

13. The lock bar of claim 12, wherein the support bar provides means for slidably retaining a plurality of mounting backs of different peg hooks thereon.

14. The lock bar assembly of claim 12, further comprising a peg hook security rod extending laterally between the sides, the peg hook security rod extending coextensively with the peg hook support bar to define a substantially constant gap along a substantial portion thereof which is configured and size to trap mounting brackets when slidably mounted on the support bar, and a larger entrance opening portion which provides means for slidably installing and removing mounting brackets of peg hooks on the support bar.

15. The lock bar merchandise system of claim 12, further comprising a label holder mounted to the product retainer.

16. The lock bar merchandise system of claim 12, wherein the lock comprises a keyed mechanism carried by the product retainer, the key mechanism having a movable latch actuated by a key, and wherein the lock includes a stop defined by one of the sides, the latch cooperating with the stop in the locked condition to prevent movement of the product retainer.

17. The lock bar merchandise system of claim 12, wherein the sides have mounts for mounting the sides to the vertical supports.

* * * * *

UNITED STATES PATENT AND TRADEMARK OFFICE

CERTIFICATE OF CORRECTION

PATENT NO. : 7,104,094 B2
APPLICATION NO. : 10/663601
DATED : September 12, 2006
INVENTOR(S) : Craig Zadak et al.

It is certified that error appears in the above-identified patent and that said Letters Patent is hereby corrected as shown below:

In claim 11, “a upwardly bent free end” should correctly read --an upwardly bent free end.--

In claim 14, “which is configured and size” should correctly read --which is configured and sized.--

Signed and Sealed this

Twelfth Day of December, 2006

JON W. DUDAS
*Director of the United States Patent and Trademark Office*